US005651459A

United States Patent [19]

Umiker

[11] Patent Number: 5,651,459

[45] Date of Patent: Jul. 29, 1997

[54] BOTTLE CRATE

[75] Inventor: Hans Umiker, Egg, Switzerland

[73] Assignee: Schoeller-Plast S.A., Switzerland

[21] Appl. No.: 428,199

[22] PCT Filed: Oct. 28, 1994

[86] PCT No.: PCT/EP94/03578

§ 371 Date: May 2, 1995

§ 102(e) Date: May 2, 1995

[87] PCT Pub. No.: WO95/12529

PCT Pub. Date: May 11, 1995

[30] Foreign Application Priority Data

Nov. 3, 1993 [DE] Germany ..... 43 37 510.3
Dec. 10, 1993 [DE] Germany ..... 43 42 245.4

[51] Int. Cl.[6] ..... B65D 21/02

[52] U.S. Cl. ..... 206/433; 206/203; 206/427; 220/514; 220/519

[58] Field of Search ..... 206/139, 427, 206/433, 591, 592, 594, 589, 588, 203, 821; 220/516, 517, 518, 519, 512, 514, 378, 358

[56] References Cited

U.S. PATENT DOCUMENTS

| | | | |
|---|---|---|---|
| 1,499,364 | 7/1924 | Goodrick | 220/358 |
| 4,162,738 | 7/1979 | Wright | 220/519 |
| 4,434,910 | 3/1984 | Groult | 220/378 |
| 4,699,292 | 10/1987 | Farrell | 220/378 |
| 5,038,961 | 8/1991 | Watanabe et al. | 220/516 |
| 5,263,605 | 11/1993 | Caton | 206/427 |
| 5,421,474 | 6/1995 | Ramillon et al. | 220/378 |

*Primary Examiner*—Paul T. Sewell
*Assistant Examiner*—Luan K. Bui
*Attorney, Agent, or Firm*—Vanophem Meehan & Vanophem, P.C.

[57] ABSTRACT

In a bottle crate for plastic bottles, for non-returnable bottles in particular, having location members formed at the crate bottom for each bottle location department, at least one perferably annular contact member made out of a material softer than that of the carrier is arranged on at least the crate-side contact faces between each location member and bottle of the lower stack layer.

34 Claims, 2 Drawing Sheets

BOTTLE CRATE

Figure 1:
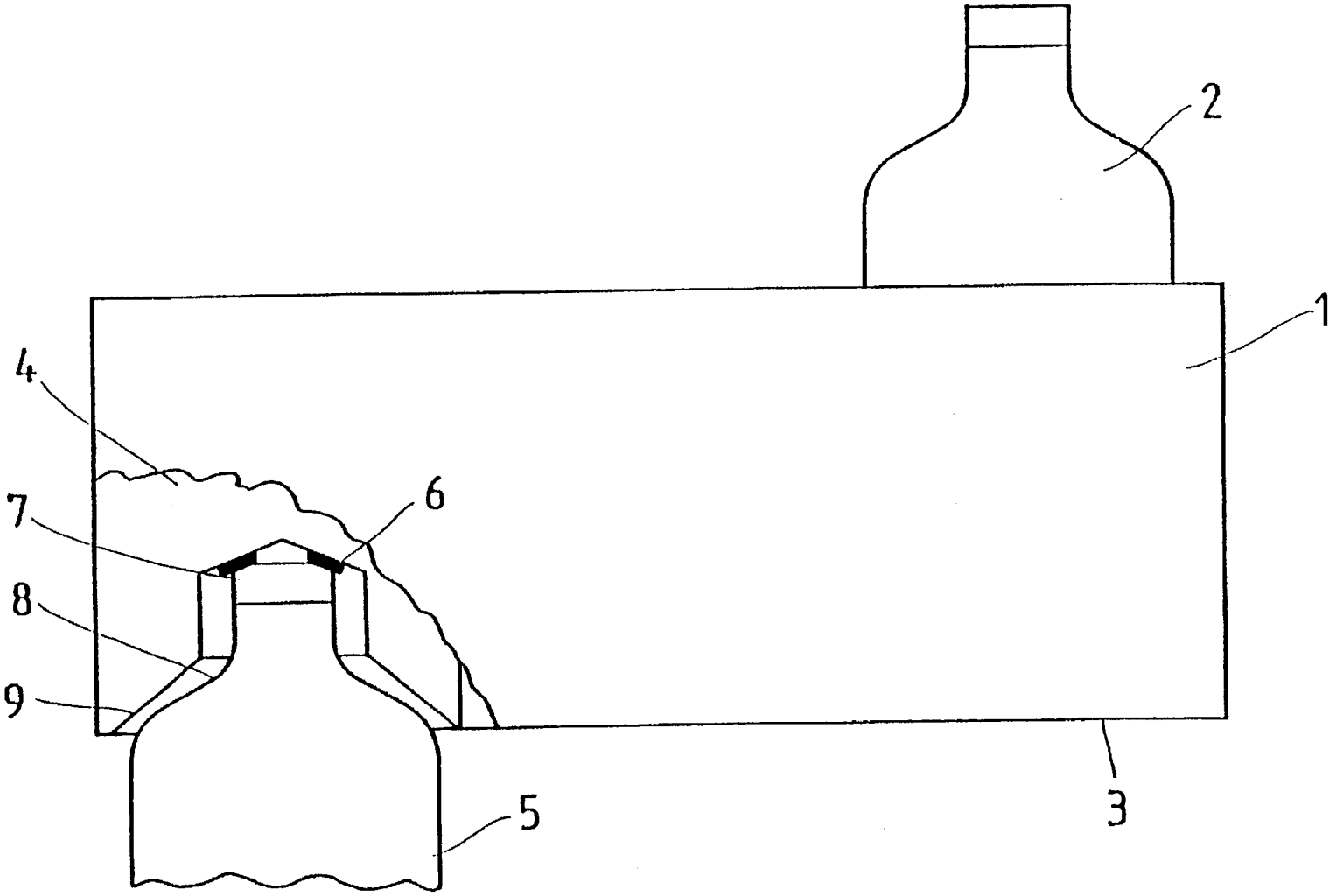

The invention relates to a bottle crate for plastic bottles in accordance with the preamble of patent ciam 1. Such bottle crated for plastic bottles accomodate the bottles each in location parts and support them using the crate bottom. Load degradation in the stack herein is directly effected through the bottles received in the crate. The invention, in particular, is applicable to bottle crates for plastic bottles made from PET in the field of disposable goods. As non-returnable bottles of that kind in many countries just are thrown away by the customers, the bottle crate, once emptied, is to be returned to the bottling firm therein requiring as little transport space as possible. For this reason, to a great extent crates are used which are similar to low-built crates.

During load degradation in the stack through the bottles received in the tray, carrying on the closing cap often damages the text on the cap and, moveoever, often causes leakage. Carrying on the bottle shoulder and/or the bottle neck scratches the bottle surface and due to the turbidity of the bottle wall gives the impression of dirt to the consumer. This effect of being scratched has different reasons, namely

- the lower crate profile lying flat on the bottle;
- bottle and crate have almost the same mechanical hardness; the crate even somewhat more than the bottle;
- due to the materials used the friction coefficient between bottle and crate is very small, for which reason the bottle turns during transport because of transport vibrations;
- dust and dust particles support such effect.

It is object of the invention to overcome the disadvantages of the described prior art, in particular, creating a bottle crate in which damage of the bottle and/or bottle closing cap of the next lower stack layer can be avoide safely but without much expenses with respect to manufacturing technology and construction of the bottle crate.

In accordance with the present invention, said object is solved by the features contained in the characterizing clause of claim 1, advantageous further develompents of the invention being characterized by the features contained in the subclaims.

In accordance with the invention, on the side of the crate at least one annular contact member made from a material softer than that of the carrier is arranged at the crate on the contact area or the contact areas between each location or receiver part and the associated bottle of the lower stack layer. Thereby, the support of the crate of the upper stack layer with respect to the bottles of the lower stack layer is effected by insertion of contact members made from a material being softer than that of the carrier, this bringing about a series of advantages. Said contact members which in a preferred embodiment may be formed by concentrically peripheral sealing rings preferably are introduced in corresponding undercuts or recesses of the accomodation members. Herein, said contact members can be held in the recesses and/or undercuts by positive locking or vacuum tension, however, preferably an injectable material is used which is injected into the undercuts and herein slightly protrudes over the crate. Instead of annular contact areas it also is possible to use individual contact pieces which are disposed in the location member in circumferential distance peripherally around the bottle. Instead of holding the contact areas in recesses etc., these can also ber realized by coating the crate bottom. A flexible resilient plastic material is used as material for said contact areas which in a preferred embodiment are made from the plastic material ethylene vinylacetate (EVA).

The advantage of the invention in particular lies in that the material binds with the crate body and that, because it consists of a flexible resilient material, it can be burdened for longer time. Moreover, it is an advantage that the contact members out of flexible resilient material can match to the bottle body. Because of the flexible resilient material of the contact areas the bottle neck and/or the bottle shoulders and/or the bottle closing cap are no longer scratched. Furthermore, by insertion of the contact area it can be achieved also that the bottle will not turn any more during transport. This, too, substantially contributes that the bottle cannot be scratched any more. Preferably, in accordance with a further aspect of the invention the material of the contact areas and the material of the crate body are chemically related in such way that the recycling process is not interfered with.

In the following embodiments of the invention are described with reference to the drawings, wherein FIG. 1 shows the schematical side view of a bottle crate, a cut having been carried out in the left-hand bottom are in the range of a location element.

Figure 2:
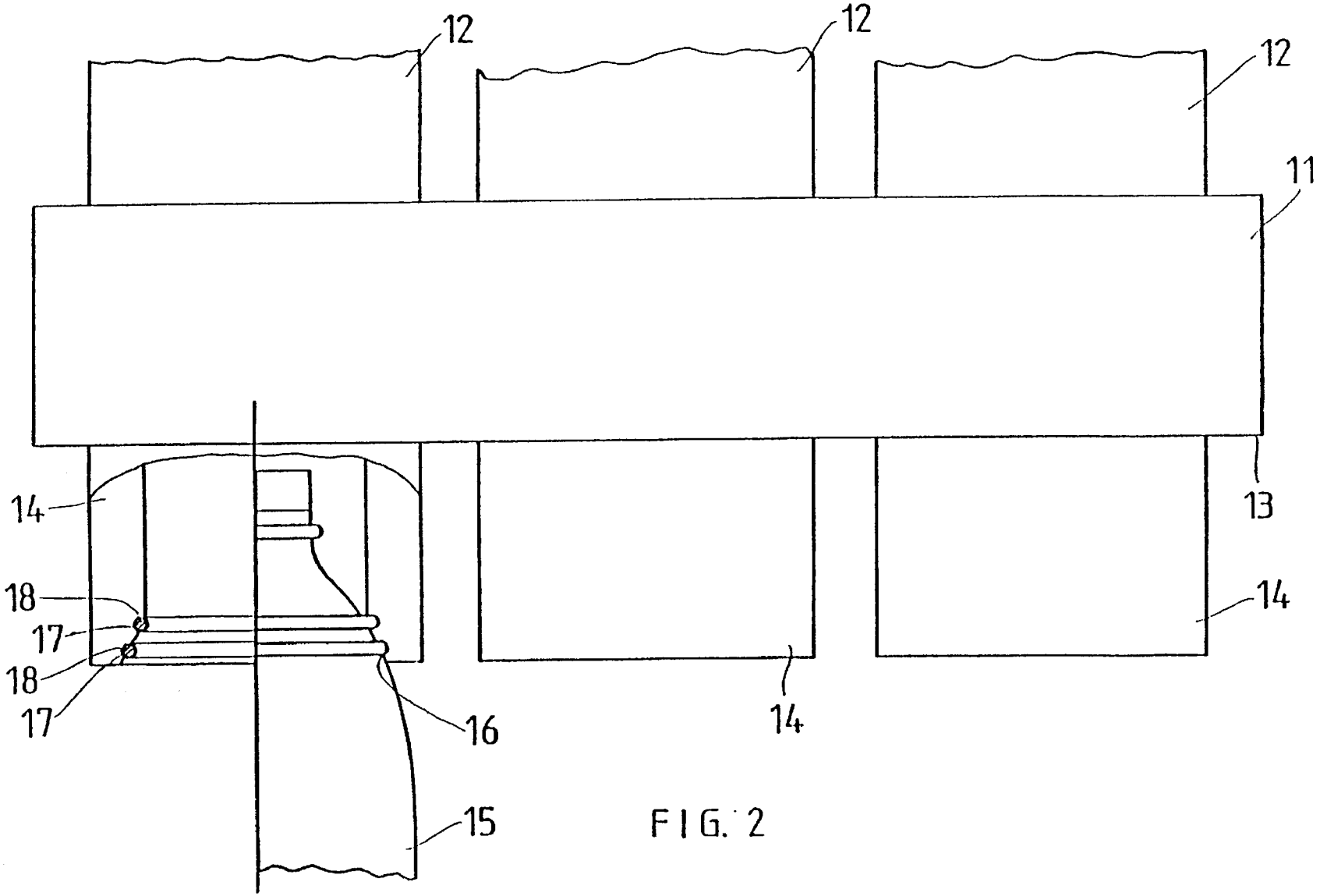

FIG. 2 shows the schematical side view of a bottle crate, a cut having been carried out in the left-hand bottom are in the range of a location sleeve.

In FIG. 1, 1 denotes a bottle crate out of plastic material serving for accomodation of several plastic bottles 2, one of those being merely schematically shown in the right-hand top side of FIG. 1. Said plastic bottles, mainly being non-returnable bottles, stand in respective bottle location members, bottle receiving members respectively, of the crate 1 and are supported on the bottom thereof. The left location member is shown in section. The bottles 5 of the lower stack layer immerge into said location member 4, the crate 1 of the upper layer being supported through said bottles 5 in the stack. This means that the bottles 5 bear the load of the upper stack layers and of those thereabove.

As can be seen from FIG. 1, the location member is formed such that it surrounds the immerging bottle 6 at its upper portion. Usually the support in the shown embodiment is directly effected through the location member 4 through the bottle closing cap referred to by 7. In the shown embodiment, however, contact faces referred to by 6 are inserted, which consist of a flexible resilient plastic material, perferably ethylene vinylacetate (EVA). Said contact faces 6 are formed at the crate bottom 3, preferably at the individual location members, by coating. This means that the support of the crate 1 of the upper stack layer with respect to the bottles 5 of the lower stack layer is effected by insertion of said coating 6. In the shown embodiment, the contact face 6 touches the bottles of the lower stack layer in the area of teh bottle closing cap 7. It, herein, is formed annularly. Instead of annularly circumferentialy formed contact faces 6 it also is possible, to use isolated contact members, wherein said contact members then are disposed in circumferential manner mit peripheral distance around the bottles, wherein just for example—3 or 4 or even more contact members can be provided for which fulfil the same function as the annular contact face 6. This embodiment is realized in such cases in particular, where the location members show projections arranged with peripheral distance or holding members by means of which the contact with the bottle of the lower stack layer is effected. Said projections and/or holding members, respectively, than are coated at least at the contact areas with the bottle.

In FIG. 2, 11 denotes a bottle crate made from plastic material, serving for accomodation of several plastic bottles 12 only merely schematically shown with their lower section in FIG. 2. Said plastic bottles perferably being made out of PET and being disposable bottles stand in respective bottle location departments of the crate 11 and are supported on the bottom there which is not shown in more detail. Location members 14 project from the bottom are 13 in downward direction, the left location member 14 being shown in section. The bottles 14 of the lower stack layer immerge into said location elements 14, wherein the crate 11 of the upper stack layer is supported in the stack through said bottles 15. This means that the bottles 14 degrade the load of the upper stack layer and those thereabove in downward direction. It can be seen that in the shown embodiment the location member 14 is formed as sleeve and as such surrounds the immerging bottle 14 at its lower portion. Usually the support in the shown embodiment would be directly effected over the location members 14 onto the bottle shoulders referred to by 16. In the shown embodiment, however, contact members in the kind of sealing rings, referred to by 17, are inserted. Said contact members 17 are accomodated in the associated groove-like or flute-like recesses 18 at the inner face of the sleeve and/or the location member 14, respectively. This means that the support of the crate 11 of the upper stack layer with respect to the bottles 15 of the lower stack layer is effected by insertion of said contact members 17. In the shown embodiment, a total of two sealing-ring-like contact members 17 are disposed on above the other in axial direction and touch the bottles 15 of the lower stack layer in the area of the respective bottle shoulder. Instead of sealing-ring-like contact members 17 being formed circumferentially it is also possible to alternatively use several single contact members 17 instead of a ring, the individual contact piece then being circumferentially arranged at peripheral distance around the bottles, wherein—for way of example only—3 or 4' or also more contact pieces can be provided for, which fulfil the same function as do the annular contact members. These contact pieces, too, are disposed in associated recesses of the inner surface of the sleeve 14 and/or the location member 14, respectively.

I claim:

1. A stackable bottle crate having bottle compartments in which bottles of a lower stack layer support the bottles of an upper stack layer, said bottles having a closing cap, a neck and a shoulder, said bottle crate comprising:

a bottom having a plurality of compartments for receiving a bottle of said bottle crate lower stack layer;

a bottle receiving area in each said compartment, said bottle receiving area defining a peripheral extent of said bottle of said bottle crate lower stack layer, said bottle receiving area having an upper portion, a lower portion and an intermediate portion; and at least one contact member made of a material softer than said bottle crate, said at least one contact member attached to said bottle receiving area such that said at least one contact member is located between said upper portion of said bottle receiving area and said bottle of said lower stack layer, said at least one contact member touching the bottle closing cap of said bottle of said lower stack layer.

2. A bottle crate as claimed in claim 1 wherein said at least one contact member is annular, said at least one annular contact member being arranged circumferentially about said bottle receiving area.

3. A bottle crate as claimed in claim 1 wherein said at least one contact member is a plurality of pieces, said plurality of pieces being arranged circumferentially about said bottle receiving area, said plurality of pieces having a peripheral distance between each piece of said plurality of pieces.

4. A bottle crate as claimed in claim 1 wherein said at least one contact member is a coating, said coating covering said bottle receiving area.

5. A bottle crate as claimed in claim 1 wherein said at least one contact member is made of a flexible, resilient material.

6. A bottle crate as claimed in claim 5 wherein said flexible, resilient material is ethylene vinylacetate.

7. A bottle crate as claimed in claim 1 wherein said bottle receiving area further comprises an annular bottom.

8. A bottle crate as claimed in claim 1 wherein said bottle receiving area further comprises a tapered bottom.

9. A bottle crate as claimed in claim 1 wherein said bottle receiving area further comprises a cammed bottom.

10. A bottle crate as claimed in claim 1 wherein said bottle receiving area further comprises a sleeve, said sleeve having an open bottom, said bottles of said lower stack layer immerging into said open bottom of said sleeve.

11. A bottle crate as claimed in claim 1 wherein said at least one contact member further comprises a plurality of concentrically circumferential contact members, said plurality of concentrically circumferential contact members being axially distant from each other.

12. A bottle crate as claimed in claim 1 wherein said bottle receiving area further comprises a plurality of grooved recesses, said at least one contact member located in said plurality of grooved recesses, said at least one contact member protruding over said plurality of grooved recesses of said bottle receiving area.

13. A bottle crate as claimed in claim 1 wherein said at least one contact member is fixed to said bottle receiving area by glue.

14. A bottle crate as claimed in claim 1 wherein said at least one contact member is fixed to said bottle receiving area by an applied coating.

15. A bottle crate as claimed in claim 1 wherein said at least one contact member is positively locked to said bottle receiving area.

16. A bottle crate as claimed in claim 1 wherein said at least one contact member is fixed to said bottle receiving area by force of tension between said at least one contact member and said bottle receiving area.

17. A bottle crate as claimed in claim 1 wherein said at least one contact member is injected into said bottle receiving area.

18. A stackable bottle crate having bottle compartments in which bottles of a lower stack layer support the bottles of an upper stack layer, said bottles having a closing cap, a neck and a shoulder, said bottle crate comprising:

a bottom having a plurality of compartments for receiving a bottle of said bottle crate lower stack layer;

a bottle receiving area in each said compartment, said bottle receiving area defining a peripheral extent of said bottle of said bottle crate lower stack layer, said bottle receiving area having an upper portion, a lower portion and an intermediate portion; and a contact member made of a material softer than said bottle crate, said contact member attached to said bottle receiving area such that said contact member is located between said intermediate portion of said bottle receiving area and said bottle of said lower stack layer, said contact member touching the bottle neck of said bottle of said lower stack layer.

19. A bottle crate as claimed in claim 18 wherein said contact member is annular, said annular contact member being arranged circumferentially about said bottle receiving area.

20. A bottle crate as claimed in claim 18 wherein said contact member is a plurality of pieces, said plurality of pieces being arranged circumferentially about said bottle receiving area, said plurality of pieces having a peripheral distance between each piece of said plurality of pieces.

21. A bottle crate as claimed in claim 18 wherein said contact member is a coating, said coating covering said bottle receiving area.

22. A bottle crate as claimed in claim 18 wherein said contact member is made of a flexible, resilient material.

23. A bottle crate as claimed in claim 22 wherein said flexible, resilient material is ethylene vinylacetate.

24. A bottle crate as claimed in claim 18 wherein said bottle receiving area further comprises an annular bottom.

25. A bottle crate as claimed in claim 18 wherein said bottle receiving area further comprises a tapered bottom.

26. A bottle crate as claimed in claim 18 wherein said bottle receiving area further comprises a cammed bottom.

27. A bottle crate as claimed in claim 18 wherein said bottle receiving area further comprises a sleeve, said sleeve having an open bottom, said bottles of said lower stack layer immerging into said open bottom of said sleeve.

28. A bottle crate as claimed in claim 18 wherein said contact member further comprises a plurality of concentrically circumferential contact members, said plurality of concentrically circumferential contact members being axially distant from each other.

29. A bottle crate as claimed in claim 18 wherein said bottle receiving area further comprises a plurality of grooved recesses, said contact member located in said plurality of grooved recesses, said contact member protruding over said plurality of grooved recesses of said bottle receiving area.

30. A bottle crate as claimed in claim 18 wherein said contact member is fixed to said bottle receiving area by glue.

31. A bottle crate as claimed in claim 18 wherein said contact member is fixed to said bottle receiving area by an applied coating.

32. A bottle crate as claimed in claim 18 wherein said contact member is positively locked to said bottle receiving area.

33. A bottle crate as claimed in claim 18 wherein said contact member is fixed to said bottle receiving area by force of tension between said contact member and said bottle receiving area.

34. A bottle crate as claimed in claim 18 wherein said contact member is injected into said bottle receiving area.

* * * * *